US008939734B2

(12) United States Patent
Hoying et al.

(10) Patent No.: US 8,939,734 B2
(45) Date of Patent: Jan. 27, 2015

(54) MOLDED PLUG FOR A COMPRESSOR

(75) Inventors: Jeffrey J. Hoying, Rossburg, OH (US); Allan J. Hartong, Fairborn, OH (US); Fadhel Zammouri, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 997 days.

(21) Appl. No.: 12/199,467

(22) Filed: Aug. 27, 2008

(65) Prior Publication Data

US 2009/0060749 A1 Mar. 5, 2009

Related U.S. Application Data

(60) Provisional application No. 60/968,477, filed on Aug. 28, 2007.

(51) Int. Cl.
*F04B 39/00* (2006.01)
*F04B 39/12* (2006.01)
*H01R 13/533* (2006.01)

(52) U.S. Cl.
CPC ..... *F04B 39/121* (2013.01); *H01R 13/533* (2013.01)
USPC ..... 417/410.1; 439/367

(58) Field of Classification Search
CPC ..... F04B 39/121; F04B 39/00; H01R 13/533
USPC ..... 417/410.1
See application file for complete search history.

(56) References Cited

U.S. PATENT DOCUMENTS 1,658,861 A 2/1928 Slade
1,658,862 A 2/1928 Slade
2,205,051 A 6/1940 Schmitt
2,658,185 A 11/1953 Hatcher, Sr.
2,728,060 A 12/1955 Doeg
3,016,511 A 1/1962 Unger
3,022,097 A 2/1962 Seniff et al.

(Continued)

FOREIGN PATENT DOCUMENTS

EP 0284633 A1 10/1988
EP 0 677 727 A2 10/1995

(Continued)

OTHER PUBLICATIONS

WO 2007074852 Translation.*

(Continued)

*Primary Examiner* — Charles Freay
*Assistant Examiner* — Christopher Bobish
(74) *Attorney, Agent, or Firm* — Harness, Dickey & Pierce, P.L.C.

(57) ABSTRACT

A plug assembly for a compressor having a shell, a terminal body on the shell, and a conductor pin extending through the terminal body, wherein a connector body of the plug assembly includes a plurality of electrical receptacles for electrical communication with the conductor pin at least partially disposed within a fence disposed around the terminal body. The plug assembly may be formed of a thermoplastic or thermoset material having a tensile modulus between 9500 MPa and 18000 MPa, and/or about 30 percent glass fibers. At least one electrical receptacle may be housed by an inner core of the plug assembly for electrical communication with the conductor pin. An annular sealing member may be supported by an outer body of the plug assembly for sealingly engaging the fence.

22 Claims, 2 Drawing Sheets

(56) References Cited

U.S. PATENT DOCUMENTS

| | | | | |
|---|---|---|---|---|
| 3,031,861 | A | 5/1962 | McCormack | |
| 3,417,361 | A | 12/1968 | Heller | |
| 3,605,076 | A | 9/1971 | Dozier | |
| 3,684,819 | A | 8/1972 | Wilson | |
| 3,696,321 | A | 10/1972 | Cooper, Jr. | |
| 3,850,496 | A | 11/1974 | Hague | |
| 3,873,656 | A | 3/1975 | Garner | |
| 4,059,325 | A | 11/1977 | Diminnie et al. | |
| 4,120,555 | A | 10/1978 | Shiflett et al. | |
| 4,252,394 | A | 2/1981 | Miller | |
| 4,469,923 | A | 9/1984 | Charboneau | |
| 4,480,151 | A | 10/1984 | Dozier | |
| 4,508,413 | A | 4/1985 | Bailey | |
| 4,523,798 | A | 6/1985 | Barrows et al. | |
| 4,551,069 | A | 11/1985 | Gilmore | |
| 4,597,581 | A | 7/1986 | Nimberger | |
| 4,712,430 | A | 12/1987 | Wareham | |
| 4,743,184 | A | 5/1988 | Sumikawa et al. | |
| 4,782,197 | A | 11/1988 | Stunzi et al. | |
| 4,840,547 | A | 6/1989 | Fry | |
| 4,925,404 | A | 5/1990 | Dutcher | |
| 4,964,788 | A * | 10/1990 | Itameri-Kinter et al. | 417/422 |
| 4,966,559 | A | 10/1990 | Wisner | |
| 4,984,468 | A | 1/1991 | Hafner | |
| 4,984,973 | A | 1/1991 | Itameri-Kinter et al. | |
| 5,035,653 | A | 7/1991 | Honkomp et al. | |
| 5,121,094 | A | 6/1992 | Ting et al. | |
| 5,134,888 | A | 8/1992 | Zylka et al. | |
| 5,152,672 | A | 10/1992 | Miyazawa et al. | |
| 5,201,673 | A | 4/1993 | Minezawa et al. | |
| 5,219,041 | A | 6/1993 | Greve | |
| 5,252,036 | A | 10/1993 | Bunch et al. | |
| 5,315,878 | A | 5/1994 | Birenheide | |
| 5,471,015 | A | 11/1995 | Paterek et al. | |
| 5,493,073 | A | 2/1996 | Honkomp | |
| 5,503,542 | A | 4/1996 | Grassbaugh et al. | |
| 5,513,603 | A | 5/1996 | Ang et al. | |
| 5,522,267 | A | 6/1996 | Lewis | |
| 5,580,282 | A | 12/1996 | Paterek | |
| 5,584,716 | A * | 12/1996 | Bergman | 439/282 |
| 5,669,763 | A | 9/1997 | Pryce et al. | |
| 5,712,428 | A | 1/1998 | Schleiferbock et al. | |
| 5,746,622 | A | 5/1998 | Consoli et al. | |
| 5,750,899 | A | 5/1998 | Hegner et al. | |
| 5,756,899 | A | 5/1998 | Ugai et al. | |
| 5,831,170 | A | 11/1998 | Sokn | |
| 5,872,315 | A | 2/1999 | Nagase et al. | |
| 5,941,730 | A | 8/1999 | Uchiyama et al. | |
| 5,984,645 | A | 11/1999 | Cummings | |
| 6,037,423 | A | 3/2000 | Nagano et al. | |
| 6,102,666 | A * | 8/2000 | Albrecht | 417/32 |
| 6,140,592 | A | 10/2000 | Paterek et al. | |
| 6,224,348 | B1 | 5/2001 | Fukanuma et al. | |
| 6,276,901 | B1 | 8/2001 | Farr et al. | |
| 6,290,528 | B1 | 9/2001 | Moore, Jr. et al. | |
| 6,332,327 | B1 | 12/2001 | Street et al. | |
| 6,350,630 | B1 | 2/2002 | Wildgen | |
| 6,351,996 | B1 | 3/2002 | Nasiri et al. | |
| 6,361,281 | B1 | 3/2002 | Wurth et al. | |
| 6,372,993 | B1 * | 4/2002 | Eckels et al. | 174/152 GM |
| 6,375,497 | B1 | 4/2002 | DiFlora | |
| 6,422,830 | B1 | 7/2002 | Yamada et al. | |
| 6,435,017 | B1 | 8/2002 | Nowicki, Jr. et al. | |
| 6,484,585 | B1 | 11/2002 | Sittler et al. | |
| 6,607,367 | B1 | 8/2003 | Shibamoto et al. | |
| 6,716,009 | B2 | 4/2004 | Sowa et al. | |
| 6,752,646 | B2 | 6/2004 | McCoy | |
| 6,755,631 | B2 | 6/2004 | Kawashima et al. | |
| 6,779,989 | B2 | 8/2004 | Makino et al. | |
| 6,866,487 | B2 | 3/2005 | Abe et al. | |
| 6,883,379 | B2 | 4/2005 | Kaneko et al. | |
| 6,910,904 | B2 | 6/2005 | Herrick et al. | |
| 6,923,068 | B2 | 8/2005 | Barron | |
| 6,925,885 | B2 | 8/2005 | Ishio et al. | |
| 7,056,104 | B2 * | 6/2006 | Kimura et al. | 417/410.1 |
| 7,077,694 | B2 | 7/2006 | Nakano et al. | |
| 7,108,489 | B2 * | 9/2006 | Yap | 417/410.1 |
| 7,252,005 | B2 | 8/2007 | Schulman | |
| 7,290,989 | B2 | 11/2007 | Jayanth | |
| 7,559,794 | B2 * | 7/2009 | Taguchi et al. | 439/533 |
| 7,866,964 | B2 | 1/2011 | Jayanth | |
| 8,235,687 | B2 * | 8/2012 | Hasegawa | 417/423.7 |
| 2002/0081899 | A1 | 6/2002 | Korber | |
| 2002/0127120 | A1 | 9/2002 | Hahn et al. | |
| 2002/0130770 | A1 * | 9/2002 | Keyworth et al. | 340/436 |
| 2002/0182935 | A1 * | 12/2002 | Monde et al. | 439/625 |
| 2004/0020299 | A1 | 2/2004 | Freakes et al. | |
| 2004/0118146 | A1 | 6/2004 | Haller et al. | |
| 2005/0028585 | A1 | 2/2005 | Matsumura et al. | |
| 2005/0028596 | A1 | 2/2005 | Gall | |
| 2005/0217383 | A1 | 10/2005 | Tohyama et al. | |
| 2006/0013697 | A1 | 1/2006 | Uratani | |
| 2006/0068626 | A1 * | 3/2006 | Hasegawa | 439/276 |
| 2006/0141838 | A1 * | 6/2006 | Kertesz | 439/272 |
| 2006/0144153 | A1 | 7/2006 | Brosh | |
| 2006/0211810 | A1 * | 9/2006 | Persigehl et al. | 524/502 |
| 2006/0275143 | A1 | 12/2006 | Jayanth | |
| 2007/0184697 | A1 * | 8/2007 | Taguchi et al. | 439/218 |
| 2008/0136122 | A1 | 6/2008 | Gambier | |
| 2009/0060749 | A1 | 3/2009 | Hoying et al. | |
| 2009/0234051 | A1 * | 9/2009 | Endtner et al. | 524/133 |

FOREIGN PATENT DOCUMENTS

| | | | | |
|---|---|---|---|---|
| EP | 1020646 | A1 | 7/2000 | |
| JP | 02104995 | | 4/1990 | |
| JP | 09032775 | | 2/1997 | |
| JP | 2001-116638 | A | 4/2001 | |
| JP | 2006097557 | | 4/2006 | |
| WO | WO 2006013872 | A1 * | 2/2006 | H01R 13/52 |
| WO | WO 2007/074852 | A1 * | 7/2007 | |

OTHER PUBLICATIONS

Written Opinion of the International Searching Authority dated Sep. 30, 2008 regarding International Application No. PCT/US2008/005971.

International Search Report dated Sep. 30, 2008 regarding International Application No. PCT/US2008/005971.

Advisory Action Before the Filing of an Appeal Brief dated Oct. 24, 2008 regarding U.S. Appl. No. 11/134,130.

Office Action Summary dated Jul. 9, 2008 regarding U.S. Appl. No. 11/134,130.

Office Action Summary dated Dec. 21, 2007 regarding U.S. Appl. No. 11/134,130.

Office Action Summary dated Aug. 13, 2007 regarding U.S. Appl. No. 11/134,130.

Office Action Summary dated Feb. 23, 2007 regarding U.S. Appl. No. 12/134,130.

International Search Report regarding International Application No. PCT/US2008/010228 dated Feb. 3, 2009.

Written Opinion of the International Searching Authority regarding International Application No. PCT/US2008/010228 dated Feb. 3, 2009.

International Preliminary Report on Patentability regarding International Application No. PCT/US2008/010228 dated Mar. 2, 2010.

First Office Action regarding Chinese Patent Application No. 200880104495.5, dated Apr. 19, 2011. English translation provided by Unitalen Attorneys at Law.

Chinese Office Action dated Nov. 28, 2008, and English translation of the Chinese Office Action entitled "Text Portion of the First OfficeAction" provided by CCPIT Patent and Trademark Law Office on Dec. 18, 2008.

Chinese Second Office Action dated Jan. 8, 2010 and issued in connection with a corresponding Chinese Application. Translation prepared by Unitalen Attorneys at Law.

Final Office Action for U.S. Appl. No. 11/134,130, dated Mar. 9, 2010.

Final Office Action for U.S. Appl. No. 11/134,130, dated May 14, 2009.

(56) References Cited

OTHER PUBLICATIONS

Final Office Action for U.S. Appl. No. 12/115,651, dated Jan. 6, 2012.
First Office Action regarding Chinese Patent Application No. 200880015473.1, dated May 23, 2011. English translation provided by Unitalen Attorneys at Law.
International Preliminary Report on Patentability dated Nov. 10, 2009 regarding International Application No. PCT/US2008/005971.
International Search Report regarding Application No. PCT/US2010/028667, mailed Oct. 28, 2010.
Non-Final Office Action for U.S. Appl. No. 11/134,130, dated Dec. 19, 2008.
Non-Final Office Action for U.S. Appl. No. 11/134,130, dated Jun. 18, 2010.
Non-Final Office Action for U.S. Appl. No. 11/134,130, dated Oct. 23, 2009.
Non-final Office Action for U.S. Appl. No. 12/115,651, dated Aug. 11, 2011.
Partial European Search Report dated Sep. 2, 2009 regarding Application No. EP05256767.
Summary of the Fourth Office Action received from the Mexican Institute of Industrial Property (IMPI) regarding Application No. PA/a/2006/005167. Summary provided by Goodrich, Riquelme y Asociados on Mar. 25, 2010.
Summary of the Second Office Action received from the Mexican Institute of Industrial Property (IMPI) regarding Application No. PA/a/2006/005167. Summary provided by Goodrich, Riquelme y Asociados on Mar. 20, 2009.
Summary of the Third Office Action received from the Mexican Institute of Industrial Property (IMPI) regarding Application No. PA/a/2006/005167. Summary provided by Goodrich, Riquelme y Asociados on Sep. 3, 2009.
Written Opinion of the International Searching Authority regarding Application No. PCT/US2010/028667, mailed. Oct. 28, 2010.
Non-Final Office Action for U.S. Appl. No. 12/730,782, mailed Oct. 24, 2012.
First Office Action regarding Chinese Application No. 201080013757.4, dated Sep. 2, 2013, and Search Report. English translation provided by Unitalen Attorneys at Law.
Final Office Action for U.S. Appl. No. 12/730,782, mailed May 13, 2013.
Non-Final Office Action regarding U.S. Appl. No. 12/730,782, mailed Feb. 21, 2014.
Second Office Action reagarding Chinese Application No. 201080013757.4, dated Apr. 16, 2014, and Supplementary Search Report. English translation provided by Unitalen Attorneys at Law.

* cited by examiner

MOLDED PLUG FOR A COMPRESSOR

CROSS-REFERENCE TO RELATED APPLICATIONS

This application claims the benefit of U.S. Provisional Application No. 60/968,477, filed on Aug. 28, 2007. The entire disclosure of the above application is incorporated herein by reference.

FIELD

The present disclosure relates to a compressor and a plug assembly for an electric terminal of a compressor.

BACKGROUND

The statements in this section merely provide background information related to the present disclosure and may not constitute prior art.

Terminal assemblies for compressors may be used to provide electric current to various inner components of the compressor. To connect the terminal assembly to an electric current, a plug may be used. These plugs are typically formed of a flexible material.

SUMMARY

A compressor comprising a shell, a compression mechanism disposed within the shell, and a motor for actuating the compression mechanism. A terminal body may be secured to the shell having at least one conductor pin extending through the terminal body. A fence may be disposed around the terminal body and secured to the shell. A plug assembly may be at least partially disposed within the fence and have an inner core surrounded by an outer body. A rigid and non-flexible thermoset or thermoplastic material may form the inner core and the outer body. At least one electrical receptacle may be housed by the inner core for electrical communication with the conductor pin, and an annular sealing member may be supported by the outer body for sealingly engaging the fence disposed at an end of the plug assembly that is at least partially disposed within the fence.

The outer body may include a circumferential groove for supporting the sealing member.

The material is flame resistant, or polyethylene terephthalate.

The sealing member may be an O-ring.

The inner core and the outer body may each be formed of different rigid and non-flexible thermoset or thermoplastic materials.

The present teachings also provide a compressor comprising a shell, a compression mechanism disposed within the shell, a motor for actuating the compression mechanism, and a terminal body secured to the shell. A plurality of conductor pins may extend through the terminal body, and a fence may be disposed around the terminal body and secured to the shell. A plug assembly formed of a thermoset or thermoplastic material including about 30% glass fibers having a connector body may include a plurality of electrical receptacles for electrical communication with the conductor pins and be at least partially disposed within the fence. An annular sealing member that may sealingly engage the fence may be disposed at an end of the connector body.

The material of the plug assembly may be flame resistant, rigid and non-flexible, or polyethylene terephthalate.

The sealing member may be an O-ring.

The plug assembly may include an inner core housing the electrical receptacle and an outer body that surrounds the inner core.

The inner core and the outer body may each formed of the thermoset or thermoplastic material including about 30% glass fibers.

The present teachings also provide a plug assembly for a compressor, comprising an inner core, and an outer body surrounding the inner core. A rigid and non-flexible thermoset or thermoplastic material may form the inner core and the outer body, at least one electrical receptacle may be housed by the inner core, and an annular sealing member may be supported by the outer body.

The material may be flame resistant, rigid and non-flexible, or polyethylene terephthalate.

The sealing member may be an O-ring.

The present teachings also provide a plug assembly for a compressor comprising a connector body formed of a thermoset or thermoplastic material including about 30% glass fibers, a plurality of electrical receptacles formed in the connector body, and an annular sealing member disposed at an end of the connector body.

The material may be flame resistant, rigid and non-flexible, or polyethylene terephthalate.

The sealing member may be an O-ring.

The present teaching also provide a method of manufacturing a plug assembly for a compressor that may include molding an inner core including at least one connector and at least one terminal connection assembly, and molding a rigid and non-flexible outer body over the inner core.

A material of the inner core may be different than a material of the outer body, or a material of the inner core and the outer body may be the same.

The material may be flame resistant, or the material may be polyethylene terephthalate.

The inner core and the outer body may be injection molded.

The step of molding the outer body may include forming a circumferential groove in the outer body.

The method may also include a step of providing a sealing member in the circumferential groove.

The present teachings also provide a molded plug kit, comprising a molded plug including multiple connectors and a plurality of wirings having different colored sheathings numbering more than the multiple connectors. The plurality of wirings may be interchangeable with the multiple connectors.

The molded plug may include an inner core surrounded by an outer body.

The outer body may be formed of a rigid and non-flexible material, a flame resistant material, or polyethylene terephthalate.

The present teachings further provide a plug assembly for a compressor including a connector body formed of a thermoplastic or thermoset material having a tensile modulus between 9500 MPa and 18000 MPa. The plug assembly may include a thermoplastic or thermoset material having a tensile modulus between 10000 MPa and 15000 MPa. A plurality of electrical receptacles formed in said connector body. An annular sealing member disposed at an end of said connector body.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
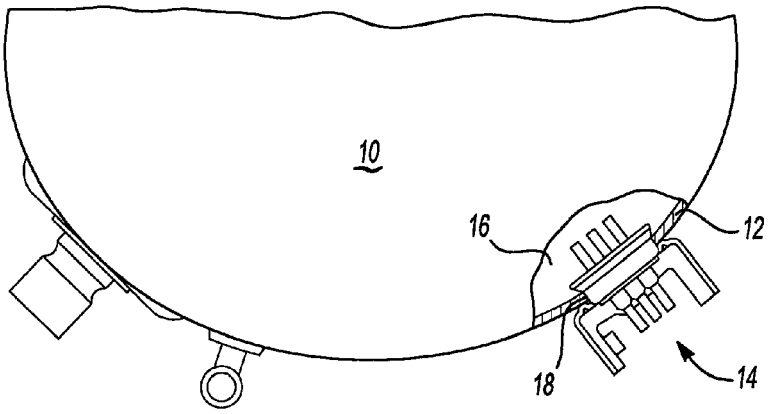
FIG. 1 is a partially cut away plan view of a hermetic shell of a hermetic compressor incorporating a terminal assembly.

The following description is merely exemplary in nature and is not intended to limit the present disclosure, application, or uses. It should be understood that throughout the drawings, corresponding reference numerals indicate like or corresponding parts and features.

FIG. 1 illustrates a hermetic compressor assembly 10 that may include a hermetic shell 12 and a terminal 14. Compressor assembly 10 may be a scroll compressor, a piston compressor, or any other type of compressor known to one skilled in the art. Shell 12 defines a sealed chamber 16 within which a motor (not shown) and compression mechanism (not shown) may be disposed. Terminal 14 may be sealingly disposed within an aperture 18 which extends through shell 12. The sealing relationship between terminal 14 and shell 12 maintains the integrity of sealed chamber 16. Terminal 14 may provide for the electrical connection between an external source of electrical power (not shown) and the motor disposed within chamber 16.

Now referring to FIGS. 2-6, terminal 14 may include a plurality of conductor pins 22, a terminal body 24, a plurality of fused glass insulators 26, a plurality of ceramic insulators 28, a silicone rubber molding 30, and a fence 32. Terminal body 24 may be a cup-shaped metal member defining a plurality of holes 34. Terminal body 24 may be sealingly disposed within aperture 18 by resistance welding or other methods known in the art.

Figure 2:
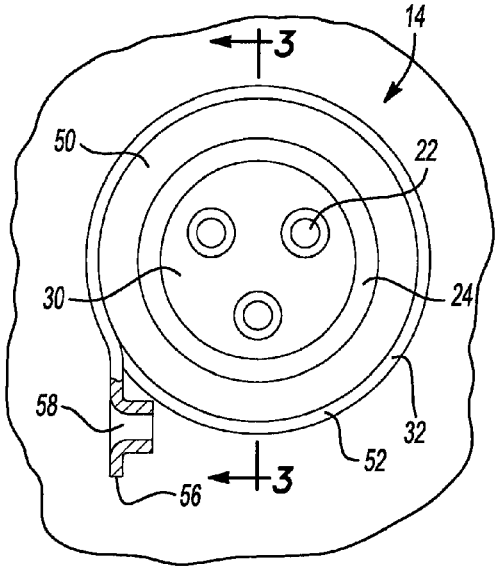
FIG. 2 is a front view of a terminal assembly.
Figure 3:
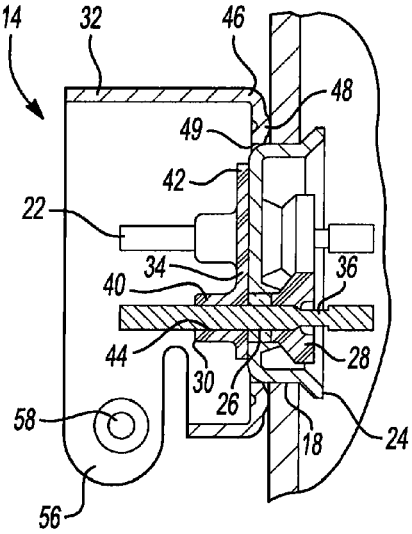
FIG. 3 is a cross-sectional side view of the terminal assembly taken in the direction of lines 3-3 in FIG. 2.
Figure 4:
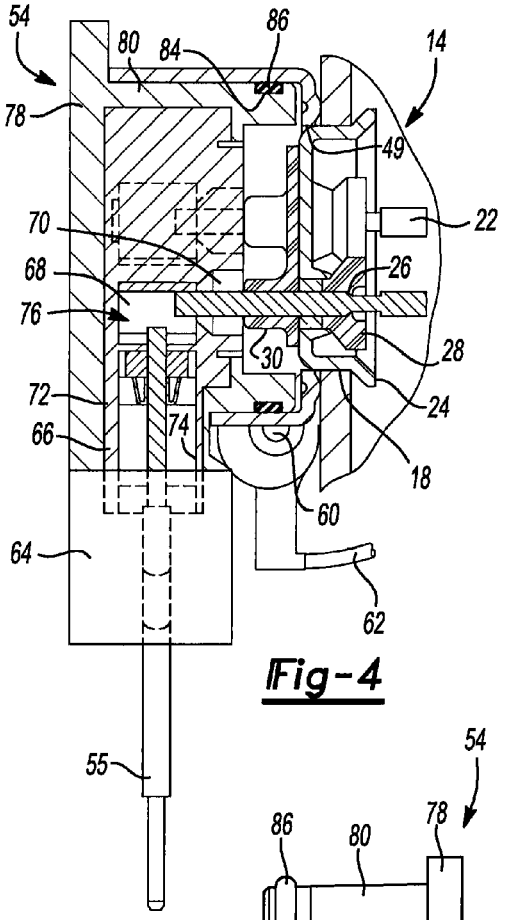
FIG. 4 is a cross-sectional side view of the terminal assembly including a terminal plug in communication with the terminal assembly.
Figure 5:
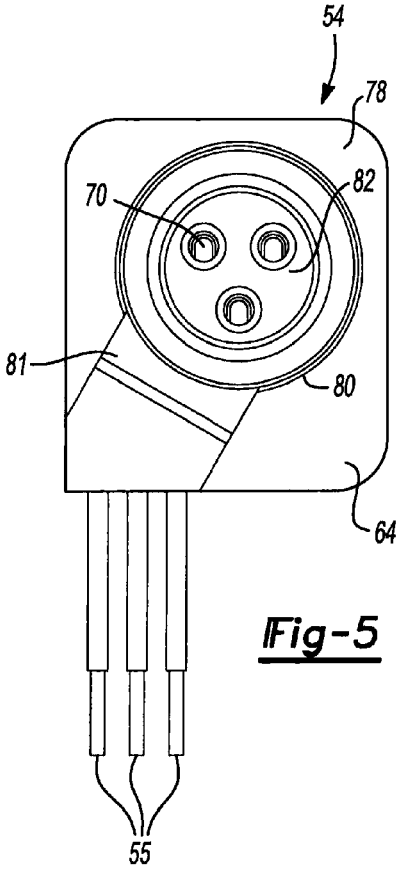
FIG. 5 is a front view of the terminal plug.
Figure 6:
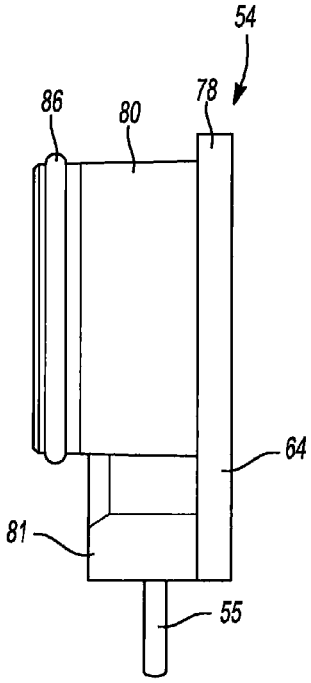
FIG. 6 is a side view of the terminal plug.

Each of holes 34 may be adapted for receiving a respective fused glass insulator 26 which may be sealingly fused to both terminal body 24 and a respective connector pin 22. Each connector pin 22 may extend through a respective fused glass insulator 26 to provide electrical communication between an exterior and interior of shell 12. Each connector pin 22 may include a reduced diameter section 36 which may act as a fuse-link in the event of an internal short circuit. FIGS. 2 to 4 show each of the reduced diameter sections 36 located within sealed chamber 16. It is within the scope of the present teachings, however, to locate reduced diameter sections 36 on the outside of shell 12.

Each connector pin 22 may have a respective ceramic insulator 28 secured to the end of pin 22 extending into chamber 16. Ceramic insulators 28 may insulate conductor pins 22 and their associated connection to the motor within chamber 16 from contact with terminal body 24 as well as provide insulation between adjacent pins 22. Silicon rubber molding 30 may be located on the outside of terminal body 24 and may include a plurality of upstanding jackets 40 which extend from a base 42. Upstanding jackets 40 may be equal to and arranged in the same pattern as the plurality of conductor pins 22. Each of upstanding jackets 40 may define an aperture 44 extending through molding 30 and be adapted to receive a respective conductor pin 22. The relationship between apertures 44 and conductive pins 22 may serve to both seal and provide oversurface insulation protection for conductor pins 22.

Fence 32 may be physically secured to the outside of shell 12 by resistance welding or other methods known to those skilled in the art. In this regard, terminal body 24 and fence 32 may be simultaneously resistance welded to shell 12 to provide a hermetic seal. Fence 32 may include a flange 46 that may have a welding bead 48 that extends circumferentially around flange 46. Welding bead 48 enhances the resistance welding operation that secures and seals fence 32 to shell 12.

Fence 32 may define an opening 49 that engages terminal body 24 to locate fence 32 on shell 12 as well as locating fence 32 with respect to conductor pins 22. This feature of locating fence 32 with respect to connector pins 22 allows for a close fit between a plug 54 and terminal 14. Fence 32 may also define a cavity 50 within which conductor pins 22 may be located. Attachment between fence 32 and shell 12 provides a seal that prohibits moisture and/or debris from leaking into cavity 50 causing corrosion of conductor pins 22.

Fence 32 also defines an opening 52 that may be adapted for receiving incoming wires 55 of plug 54 as shown in FIG. 4. The portion of the wall that is cut out of fence 32 to form opening 52 is bent out generally parallel to conductor pins 22 to an approximate vertical position as shown in FIGS. 2 and 3 to form a grounding lug 56. Grounding lug 56 defines an aperture 58 that is adapted to receive a self tapping screw 60 that holds a grounding wire 62 under terminal body 24. Fence 32 not only provides for the sealing of the electrical connection for terminal 24, but also protects conductor pins 22 from inadvertent damage due to handling of the compressor of assembly 10 by the manufacture of the compressor, the manufacture of the apparatus utilizing compressor assembly 10, and any surface personnel involved with servicing compressor assembly 10 or the apparatus utilizing compressor assembly 10.

Plug 54 allows for the connection of the portion of the conductor pins 22 located outside of shell 12 to the plurality of wires 55 that extend between plug 54 and the external supply of electrical power. Plug 54 may be a molded plug formed of a dual body structure. Plug 54 may include a molded outer body 64 surrounding a molded inner core 66. Inner core 66 houses connectors 68 that provide a female electrical receptacle 70 for receiving the respective connector pin 22. The plurality of receptacles 70 are equal in number to and arranged in the identical pattern to conductor pins 22 of terminal 14. The connection between conductor pins 22 and receptacles 70 provides for both an electrical connection between the two components as well as retention for keeping plug 54 in position on terminal 14. In addition, the location of receptacles 70 within plug 54 insures that the separation between wires 55 may be maintained.

Inner core 66 also includes a radially extending housing 72 that has a plurality of conduits 74 that provide access for the plurality of wires 55 that extend between plug 54 and the external source of electrical power. Housing 72 enables wires 55 to travel into plug 54 in an orderly manner and cooperate with receptacles 70 that include connectors 68 for conductor pins 22. Conduits 74 house terminal connection assemblies 76 that allow electrical communication between wires 55 and connectors 68.

Outer body 64 may include an end cap 78, a connector body 80, and a housing cover 81 that surround inner core 66. Cap 78 may seat against the outside edge of fence 32 when plug 54 is properly installed onto terminal 14. The seating of cap 78 against fence 32 aids in the sealing of cavity 50. Connector body 80 extends from cap 78 into cavity 50 and includes a pocket 82 which provides clearance for silicon rubber molding 30. It should be understood, however, that while connector body 80 is shown as having a single pocket 82, it is within the scope of the present teachings to provide a plurality of pockets equal to and in the same pattern as the plurality of conductor pins 22. Housing cover 81 covers radially extending housing 72.

An end of connector body 80 that mates with terminal 14 may be provided with a circumferential groove 84 that supports an annular sealing member 86. Sealing member 86 may be an O-ring having, as illustrated in FIG. 4, a generally round cross-section, or any other type of annular seal that may provide a seal between the interior wall of fence 32 and connector body 80. For example, sealing members having generally quadrilateral cross-sections or generally triangular cross-sections may be used. Regardless of the type of sealing member used, during connection of plug 54 to terminal 14, air may be forced pass sealing member 86 such that any effort to remove plug 54 may be resisted by the suction created within cavity 50 through the sealing member 86.

In addition, sealing member 86 ensures that moisture and/or debris will not be allowed to enter cavity 50 and corrupt the various electrical components including connector pins 22 and receptacle 70. Fence 32 in conjunction with the recessing of receptacle 70 at the bottom of pocket 82 ensures that electrical communication between conductor pins 22 and receptacle 70 will be terminated prior to pins 22 being able to be accessed by anyone removing plug 54 to service the assembly. This safety feature ensures that plug 54 must be installed to operate compressor 10 eliminating any access to the conducting portion or wire 55 while compressor 10 is connected to the power source.

Inner core 66 and outer body 64 may be molded from materials such as thermoset materials or thermoplastic materials. In this regard, inner core 66 and outer body 64 may be formed of different thermoset or thermoplastic materials, or be formed of the same material. Regardless, materials that are sufficiently rigid and non-flexible, flame resistant, and electrically insulating may be used. In addition to rigidity, flame resistance, and insulation properties, the material for inner core 66 and outer body 64 should provide adequate chemical resistance, resistance to oil, and be a high temperature material.

The selected thermoset or thermoplastic material may have a rigidity defined by the tensile modulus of the selected material. In addition, the selected thermoset or thermoplastic material may have a flame resistance defined by its ability to withstand a glow wire flammability ignition test of 775 degrees Celsius (C) and a glow wire flammability index of 850 degrees C. In addition, the selected thermoset or thermoplastic material may have a density in the range of 1.50 g/cm$^3$ to 1.75 g/cm$^3$, a tensile modulus in the range of 9500 Megapascal (MPa) to 18000 MPa, and a melting point in the range of 240 degrees C. to 295 degrees C. The tensile modulus range for the selected thermoset or thermoplastic may be further defined between 10000 MPa to 15000 MPa. Furthermore, the selected material should be able to withstand ball pressure testing at 125 degrees C. Examples of materials that are rigid, flame resistant, and electrically insulating are polyethylene terephthalate, polybutylene terephthalate, polyamide 4,6, and polyamide 6,6. Moreover, mixtures of polycarbonate and ABS (acrylonitrile butadiene styrene) are suitable. To further increase the rigidity, flame resistance, and insulating properties of these materials for inner core 66 and outer body 64, a glass fiber filler content that ranges between 30% and 50% may be used.

To form the dual body structure of plug 54, the thermoset or thermoplastic material used for plug 54 may be molded during a two-step process. In this regard, inner core 66 of plug 54 including terminal connection assemblies 76 and connectors 68 may be molded first. After inner core 66 is formed, outer body 64 may be molded over inner core 66. To mold plug 54, an injection molding process may be used. It is not out of the scope of the present teachings, however, to use a compression molding process to form inner core 66 and outer body 64. Alternatively, inner core 66 and outer body 64 may be molded using different molding processes. For example, inner core 66 may be injection molded and outer body 64 may be overmolded to inner core 66 using a compression molding process, or vice versa. Regardless, one skilled in the art would acknowledge and appreciate that any type of molding processes may be used without departing from the spirit and scope of the present teachings.

Wires 55 of molded plug 54 may be provided with sheathings that have different colorings. In this regard, different original equipment manufacturers (OEMs) may require different colored wirings for various applications. Molded plug 54, therefore, may be provided as a kit that includes a plurality of different colored wirings that may be interchanged depending on the various OEMs using molded plug 54. For example, wirings 55 may be provided with a red wire, a blue wire, and a black wire for one application, while yellow, orange, and green wirings may be used for a different application. By providing molded plug 54 in a kit, each of the different colored wirings may be provided with molded plug 54 and changed depending on the specific application desired.

The above description of the present teachings is merely exemplary in nature and, thus, variations that do not depart from the gist of the present teachings are intended to be within the scope of the present teachings. Such variations are not to be regarded as a departure from the spirit and scope of the present teachings.

What is claimed is:

1. A compressor comprising:

a shell;

a compression mechanism disposed within said shell;

a motor for actuating said compression mechanism;

a terminal body secured to the shell;

at least one conductor pin extending through said terminal body;

a fence disposed around said terminal body and secured to said shell;

a plug including at least one electrical receptacle for electrical communication with said conductor pin at least partially disposed within said fence, and having an inner core surrounded by an outer body, said outer body having an end cap, a connector body extending from said end cap and including an inner surface opposing and in contact with an outer surface of said inner core, and an annular flange extending from said inner surface, said inner core disposed between said end cap and said annular flange and contacting said inner surface of said connector body along an entire length of said inner surface located between said end cap and a surface of said annular flange that opposes and is substantially parallel to said end cap; and an annular sealing member supported by said outer body for sealingly engaging said fence disposed at an end of said plug assembly that is at least partially disposed within said fence.

2. The compressor of claim 1, wherein said outer body includes a circumferential groove for supporting said sealing member, said sealing member being separate and apart from said outer body.

3. The compressor of claim 1, wherein said plug is flame resistant.

4. The compressor of claim 1, wherein said sealing member is an O-ring.

5. The compressor of claim 1, wherein at least one of said inner core and said outer body is formed from a material that includes glass fibers.

6. The compressor of claim 5, wherein said material includes between 30 percent and 50 percent glass fibers.

7. The compressor of claim 1, wherein said inner core is formed from a material that is operable to withstand a glow wire flammability index of 850 C.

8. The compressor of claim 1, wherein each of said inner core and said outer body is formed from one of a thermoplastic material and a thermoset material.

9. A plug assembly for a compressor, comprising:

an inner core having an outer surface;

an outer body surrounding said inner core and having an end cap, a connector body extending from said end cap and including an inner surface opposing and in contact with said outer surface of said inner core, and an annular flange extending from said inner surface and defining a first surface formed substantially parallel to and opposing said end cap, a second surface formed substantially parallel to said end cap and disposed on an opposite side of said annular flange than said first surface, and a third surface extending substantially parallel to said inner surface and between said first surface and said second surface, said inner core opposing said third surface and terminating at said second surface;

at least one electrical receptacle housed by said inner core; and an annular sealing member encircling said outer body.

10. The plug assembly of claim 9, wherein at least one of said inner core and said outer body is formed from a material that is flame resistant.

11. The plug assembly of claim 9, wherein said sealing member is an O-ring separate and apart from said outer body.

12. The plug assembly of claim 9, wherein at least one of said inner core and said outer body is formed from a material that includes glass fibers.

13. The plug assembly of claim 12, wherein said material includes between 30 percent and 50 percent glass fibers.

14. The plug assembly of claim 9, wherein said inner core is formed from a material that is operable to withstand a glow wire flammability index of 850 C.

15. The plug assembly of claim 9, wherein each of said inner core and said outer body is formed from one of a thermoplastic material and a thermoset material.

16. The plug assembly of claim 9, wherein said inner core is spaced apart from said third surface.

17. The plug assembly of claim 9, wherein said inner core is substantially flush with said second surface.

18. A compressor comprising:

a shell;

a compression mechanism disposed within said shell;

a motor for actuating said compression mechanism;

a terminal body secured to the shell;

at least one conductor pin extending through said terminal body;

a fence disposed around said terminal body and secured to said shell;

a plug including at least one electrical receptacle for electrical communication with said conductor pin at least partially disposed within said fence, and having an inner core surrounded by an outer body, said outer body having an end cap, a connector body extending from said end cap and including an inner surface opposing an outer surface of said inner core, and an annular flange extending from said inner surface and defining a first surface formed substantially parallel to and opposing said end cap, a second surface formed substantially parallel to said end cap and disposed on an opposite side of said annular flange than said first surface, and a third surface extending substantially parallel to said inner surface and between said first surface and said second surface, said inner core having a first surface in contact with said end cap and a second surface disposed on an opposite end of said inner core than said first surface of said inner core, said second surface of said inner core being substantially flush with said second surface of said annular flange; and an annular sealing member supported by said outer body for sealingly engaging said fence disposed at an end of said plug assembly that is at least partially disposed within said fence.

19. The compressor of claim 18, wherein said outer body includes a circumferential groove for supporting said sealing member, said sealing member being separate and apart from said outer body.

20. The compressor of claim 18, wherein at least one of said inner core and said outer body is formed from a material that is flame resistant.

21. The compressor of claim 18, wherein each of said outer body and said inner core is formed from one of a thermoplastic material and a thermoset material.

22. The compressor of claim 18, wherein at least one of said inner core and said outer body is formed from a material that includes glass fibers.

* * * * *